US005077846A

United States Patent [19]

Wheeler, III et al.

[11] Patent Number: 5,077,846

[45] Date of Patent: Jan. 7, 1992

[54] CRIB STRUCTURE

[76] Inventors: Charles E. Wheeler, III; Kathleen J. Wheeler, both of 2105 Dolphin St., Marathon, Fla. 33050

[21] Appl. No.: 177,792

[22] Filed: Nov. 4, 1985

Related U.S. Application Data

[63] Continuation of Ser. No. 568,649, Jan. 6, 1984, abandoned, which is a continuation-in-part of Ser. No. 408,028, Aug. 13, 1982, abandoned.

[51] Int. Cl.[5] ..... A47D 7/00

[52] U.S. Cl. ..... 5/93.2; 5/93.1

[58] Field of Search ..... 5/93.1, 93.2, 100

[56] References Cited

U.S. PATENT DOCUMENTS

| | | | |
|---|---|---|---|
| 185,960 | 1/1877 | Powers | 5/100 |
| 766,236 | 8/1904 | Foster | 5/100 |
| 1,164,243 | 12/1915 | Wasserman | 5/93 R |
| 1,285,909 | 11/1918 | Bloom | 5/93 R |
| 1,378,518 | 5/1921 | Boardman | 5/100 |
| 1,907,298 | 5/1933 | Kroll | 5/100 |
| 2,223,955 | 12/1940 | Greenbaum | 5/93 R |
| 2,455,340 | 11/1948 | Newman | 5/100 |
| 2,677,832 | 5/1954 | Christensen | 5/93 R |
| 3,821,822 | 7/1974 | Borreggine | 5/93.2 |
| 4,361,919 | 12/1982 | Hull | 5/93.2 |
| 4,525,883 | 7/1985 | Necowitz | 5/93.2 |
| 4,982,464 | 1/1991 | Lucero | 5/93.2 |

FOREIGN PATENT DOCUMENTS

| | | | |
|---|---|---|---|
| 2601572 | 1/1988 | France | 5/93.2 |

*Primary Examiner*—Vinh T. Luong

*Attorney, Agent, or Firm*—Armstrong, Nikaido Marmelstein, Kubovcik & Murray

[57] ABSTRACT

A crib structure sized to support an infant therein in a prone position and specifically structured to include a first and a second crib side normally disposed in spaced apart parallel relation to one another when the assembly is in a crib configuration but detachable from end portions of the crib and securable along with designed corner post pairs to auxiliary bedding support structure which is structured and dimensioned after its attachment to respective crib sides to support the normal sized adult and be assembled in a substantially conventional bed configuration.

2 Claims, 10 Drawing Sheets

CRIB STRUCTURE

This is a continuation of application Ser. No. 568,649, filed Jan. 6, 1984, which in turn is a continuation-in-part application of presently pending U.S. application Ser. No. 408,028 filed on Aug. 13, 1982, both of which are now abandoned.

FIELD OF THE INVENTION

The present invention is directed towards a convertible crib assembly normally sized for infant support and structured for conversion from its crib configuration to a substantially adult size conventionally configured bed.

DESCRIPTION OF THE PRIOR ART

Conventional baby cribs are primarily designed to provide a baby, small infant, etc., with a safe area in which to sleep, rest, or freely be positioned in a prone position. Accordingly, cribs are generally smaller than adult beds and have a protective wall surrounding the mattress or horizontal surface on which the baby reclines. This surrounding wall is provided to prevent babies from falling from the crib when sleeping or even when active. On most cribs the wall comprises a head board, a foot board and two side portions serving as side rails. To facilitate easy manipulation of the baby, cribs are designed with mattresses somewhat higher than an adult bed. Therefore, in many cribs, at lest one of the side rails slides downwardly relative to its two supporting corner posts or otherwise folds away to give an adult easy access to the baby.

For at least sixty years people have been designing cribs convertible for other uses after being outgrown by the infant wherein the crib structure usually is converted to other forms of furniture. Many of these have been converted to larger beds. However, heretofore the prior art does not disclose a crib with components designed to be used with a wide bedding support to build contemporary standard size single or double beds with a foot and/or head board attached thereto in the normal fashion.

As is well recognized in the prior art, in order to successfully make a conversion to an adult bed, the surrounding wall must be removed in total or in part, and the mattress supporter and mattress must be lowered and/or changed to support a larger mattress. Generally speaking, in that the adult mattress is wider to accommodate the larger size of an adult, the cribs head board and foot boards are normally too small for incorporation into the adult bed. Therefore, the conversions referred to above have included extending structural portions of the crib or replacing structural portions with larger similar portions. While this type of design may be functional, it frequently loses or eliminates the advantages normally associated with converting the original crib configuration into a standard size bed since almost all new components are used anyway.

Prior art structures of the type referred to above are disclosed in the following U.S. Pat. Nos.: Fitz, 399,660; Bloom, 1,285,909; Christensen, 2,677,832; Gottfried, 3,299,450; Spencer, 3,383,718; Gottfried, 3,403,412; and Spencer, 3,979,783.

SUMMARY OF THE INVENTION

The present invention is directed towards a convertible crib assembly of the type which has components some of which are detachable from one another and then capable of being reassembled along with auxiliary bedding support structure to define a substantially standard size and conventionally configured adult bed.

More specifically, the crib assembly comprises a first crib side and a second crib side disposed in substantially parallel, spaced apart relation to one another when in a crib configuration. Crib end portions are disposed in interconnecting relation to the first and second crib sides at opposite ends thereof wherein the crib end portions are also disposed in spaced apart relation to one another. A first corner post pair is fixedly attached to the first crib side and is further structured to define at least a part of opposite end portions connected between the first and the second crib sides. Similarly, a second corner post pair is connected to opposite ends of the second crib side bu is removably secured thereto and capable of being re-attached when converted from the crib configuration to the adult bed configuration as set forth below.

A first connecting means and a second connecting means are mounted on said first corner post pair and said second corner post pair respectively and include at least one and preferably two elongated connector elements disposed in spaced apart substantially parallel relation to one another and in transverse orientation to the plane of respective first and second crib sides. Each connector element comprising the first and second connector means are disposed in supporting, interconnecting relation to opposite ends of auxiliary support bedding wherein such auxiliary support structure is interconnected at opposite ends thereof to the first crib side and the second crib side, which now are disposed in the adult bed configuration once being detached from the end portions of the crib structure. Such auxiliary support structure is dimensioned and configured, when in such attached position, to support a mattress of conventional size.

Other structural features of the present invention include upstanding extensions of the first corner post pair and second corner post pair wherein such upstanding extension may have an overhanging canopy disposed in spaced apart and substantially covering relation to the adult mattress now supported on the auxiliary bedding support structure. It is important to note that the corner post extensions and canopy structure are provided primarily for purposes of decoration and the present invention is directed towards a convertible bed and/or crib structure whether or not such additional decorative structure exists.

Another embodiment of the present convertible bed and crib assembly comprises the converting of a crib assembly to an "infant's bed" or bed of generally conventional configuration but effectively incorporating the same overall bedding size, configuration and structure. Such modification is accomplished by the removal of one end portion and the specific structure of the first and the second crib side each into removably secured sections. Therefore, when it is desired to convert the subject structure from the crib configuration to the infant bed configuration, one crib end portion and one section of each of the first and second crib sides is removed to effectively open up one-half of the first and second crib sides as well as the end thereof so as to eliminate any foot board portion which may normally be associated with infant or larger adult size beds.

The invention accordingly comprises the features of constructions, combination of elements and arrangements of parts that will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DETAILED DESCRIPTION OF THE PREFERRED EMBODIMENT

Figure 1:
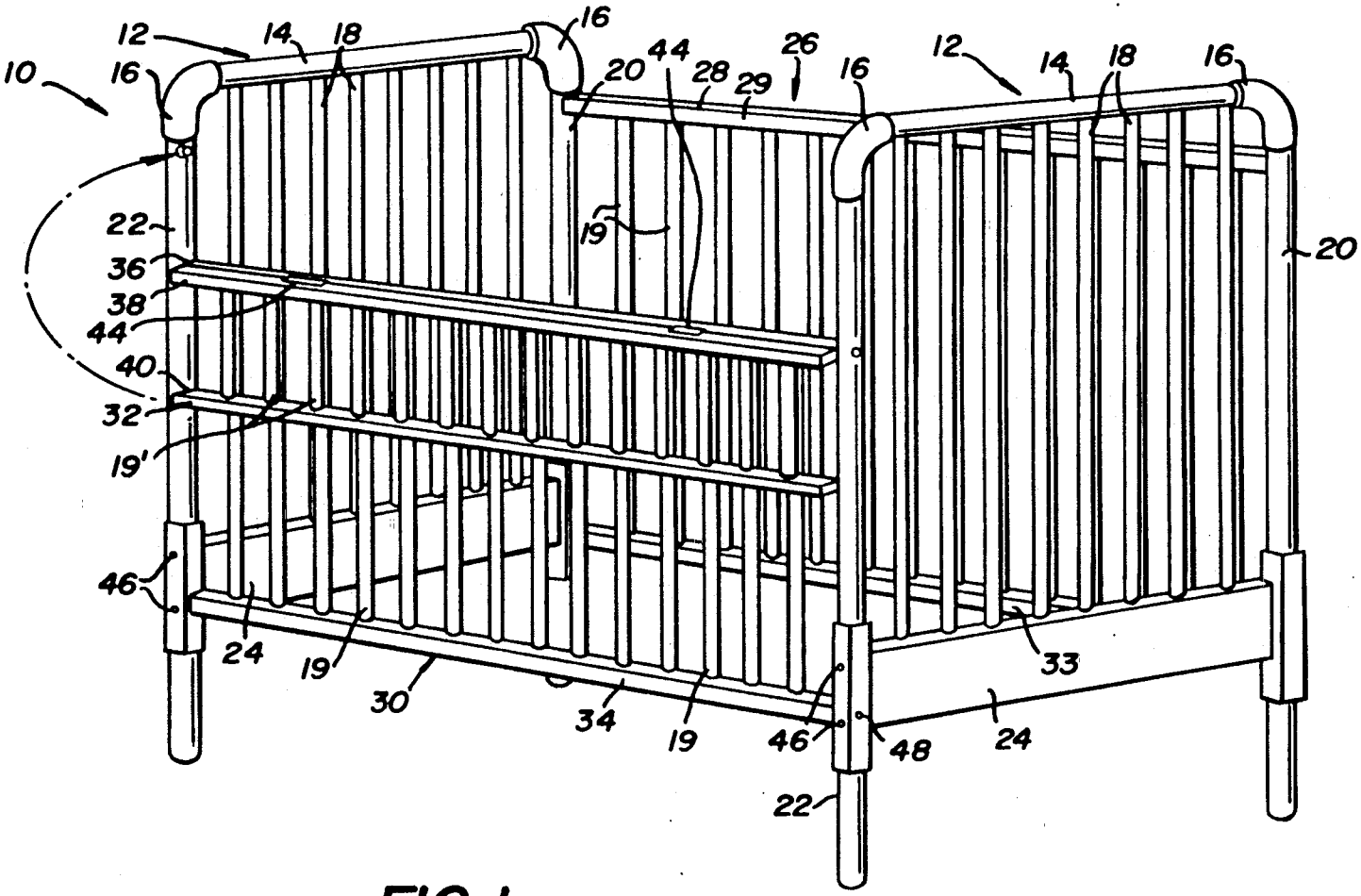
FIG. 1 is an isometric view of the subject assembly in a crib configuration.

As shown in the accompanying figures, the present invention includes a first embodiment (FIGS. 1 through 4) having a crib assembly generally indicated as 10 (FIG. 1). The crib assembly 10 includes oppositely disposed and parallel and spaced apart end portions 12 serving to interconnect a first crib side 26 and a second crib side 30 also disposed in spaced apart substantially parallel relation to one another. When the various components of the subject embodiment are interconnected in the crib configuration as shown in FIG. 1, the first and second sides 26 and 30 respectively and the crib end portions 12 define a surrounding wall which offers protection to babies or infants maintained on the interior thereof when either playing or sleeping. Such protection includes generally the prevention of inadvertent falling or removal of the baby from the crib. It is intended that a supporting mattress and proper bedding be attached in the conventional fashion adjacent to and in surrounded relation by base rails 33 and 34 of the first and the second crib side portions and base boards 24 of both end portions. Further, both end portions 12 include spaced apart bars or like elements 18 extending upwardly from the base board 24 and connected along its upper peripheral edge to a top rail 14.

The first crib side 26 includes a base rail 33 and a plurality of integrally connected substantially spaced apart and parallel bars or like structure 19. These bars 19 are secured to a top rail 29 which, may include a teething strip 28 secured along the upper peripheral edge thereof as is well known in the prior art.

The second crib side 30 includes a base rail 34 and a plurality of spaced apart substantially parallel poles or like structure 19 extending upwardly from the base rail 34 and further interconnected to a top rail 36. The embodiment of FIG. 1 further includes a fold-down panel generally indicated as 32 and hingedly attached as at 44 to the top rail 36 panel 32 includes spaced apart parallel base and top rails 38 and 40 interconnected in supported relation to a plurality of poles or like structure 19'.

The embodiments of FIGS. 1 through 4 further include a first pair of corner posts including individual spaced apart corner post elements 20 fixedly secured at opposite ends of the first crib side 26 through attachment to base and top rails 33 and 29 respectively. Similarly, a second pair of corner posts are defined by individual corner post elements 22 secured to the second crib side 30 in a similar manner, being secured at opposite ends to base and top rails 34 and 36 respectively.

Both the first pair of corner posts 20—20 and the second pair of corner posts 22—22 are specifically structured to define at least a portion of each of the opposite end portions 12 through interconnection by curved, or similarly configured connecting joints 16 attached to the top rail 14 of each of the end portions 12. This interconnection between the connecting joints 16 is such as to be detachable from the uppermost free end of each corner post 20 and 22 and such removable attachment may be accomplished by a dowel and socket connection. Individual dowels 23 are integrally or otherwise securely attached to the top of the individual corner post elements 20 and similarly, ends of individual dowels 25 are integrally or otherwise attached to corner post elements 22. These dowels are dimensioned and configured to fit within sockets (not shown) within the curved joints 16.

Figure 2:
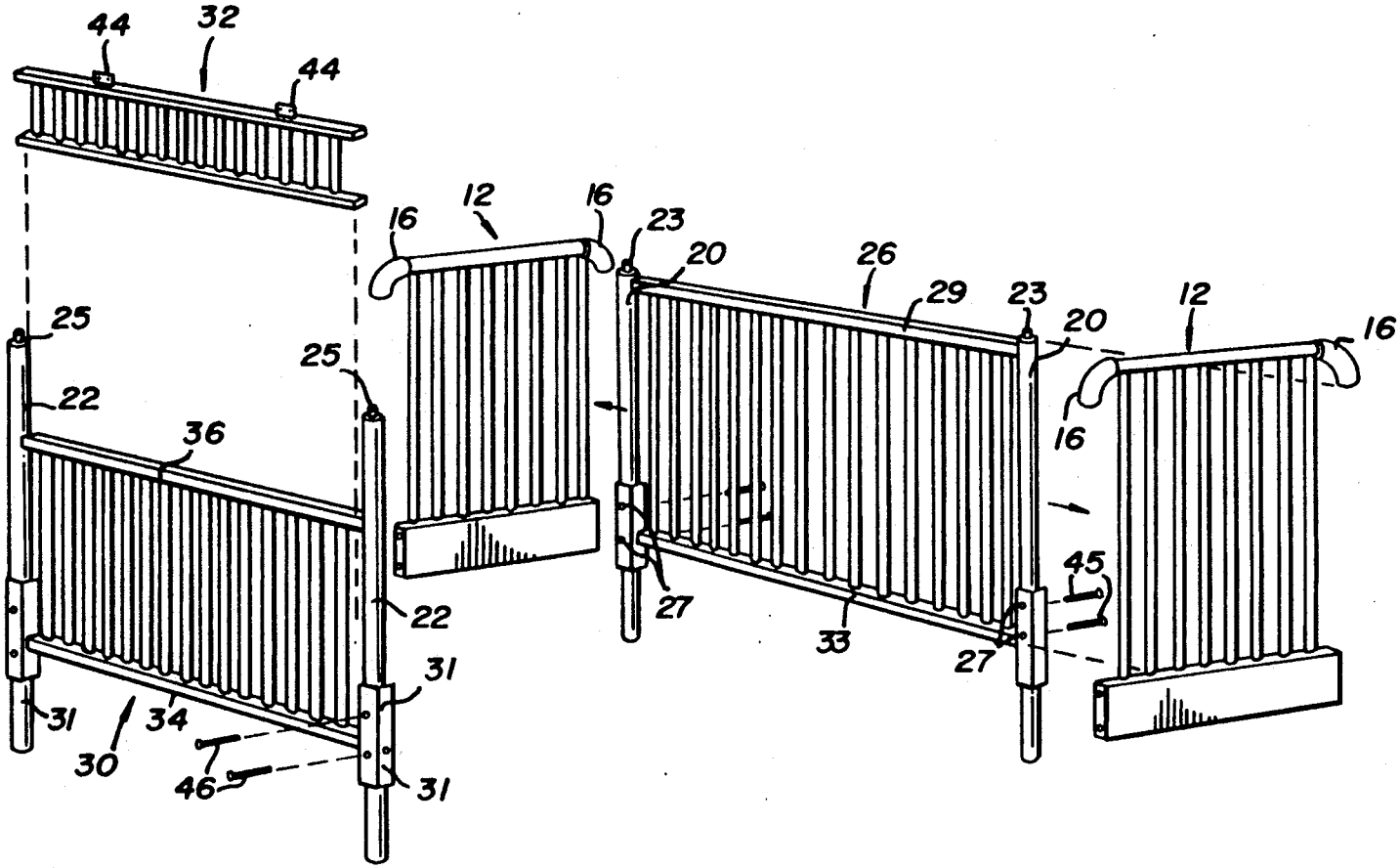
FIG. 2 is an isometric view of the various components in exploded or separated relation to one another showing component disassembly.
Figures 3, 5, 6:
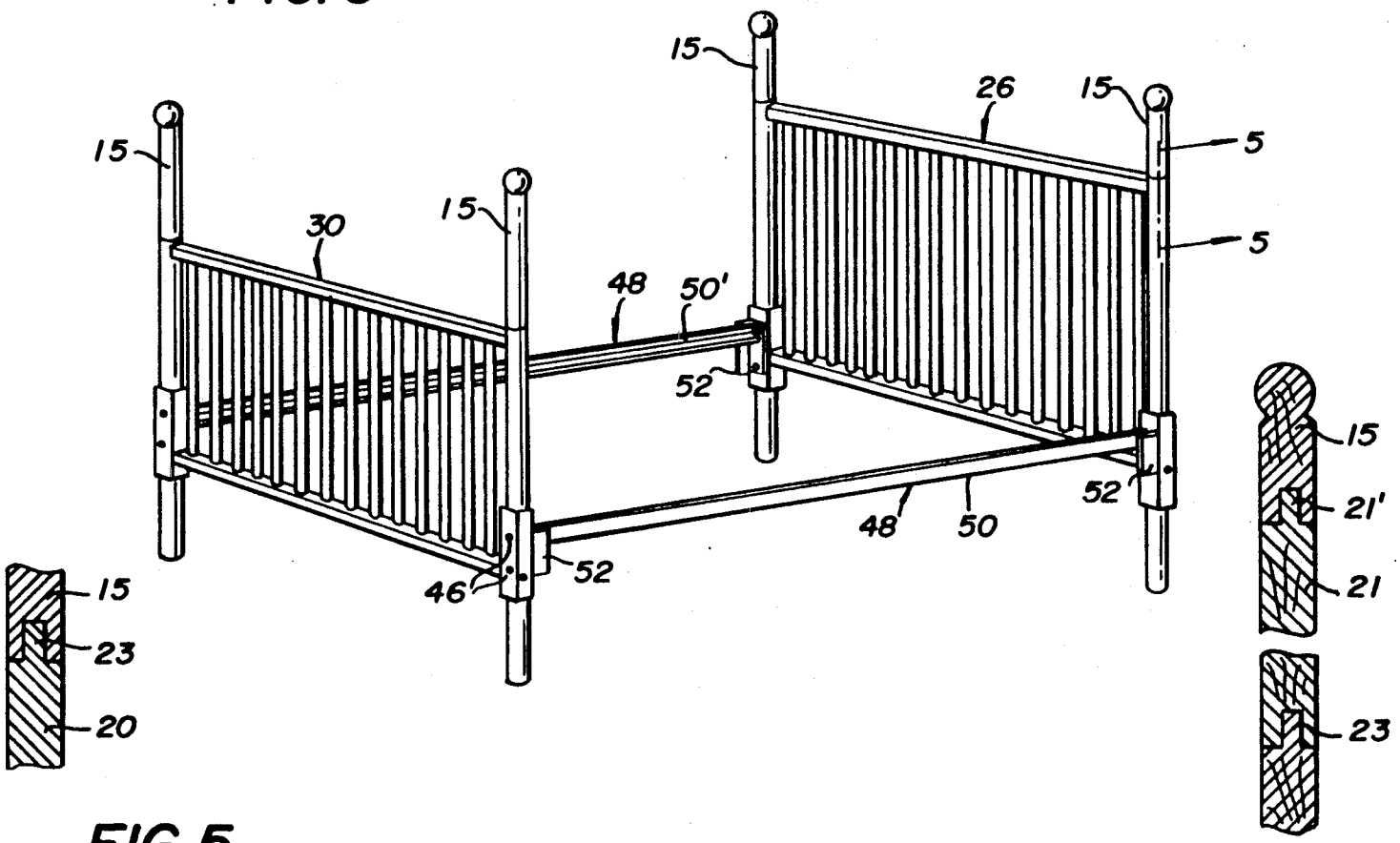
FIG. 3 a view of predetermined components of the present invention in an assembled state defining an adult size bed configuration.
FIG. 5 a sectional view along line 5—5 of FIG. 3.
FIG. 6 a sectional view along line 6—6 of FIG. 4.
Figure 4:
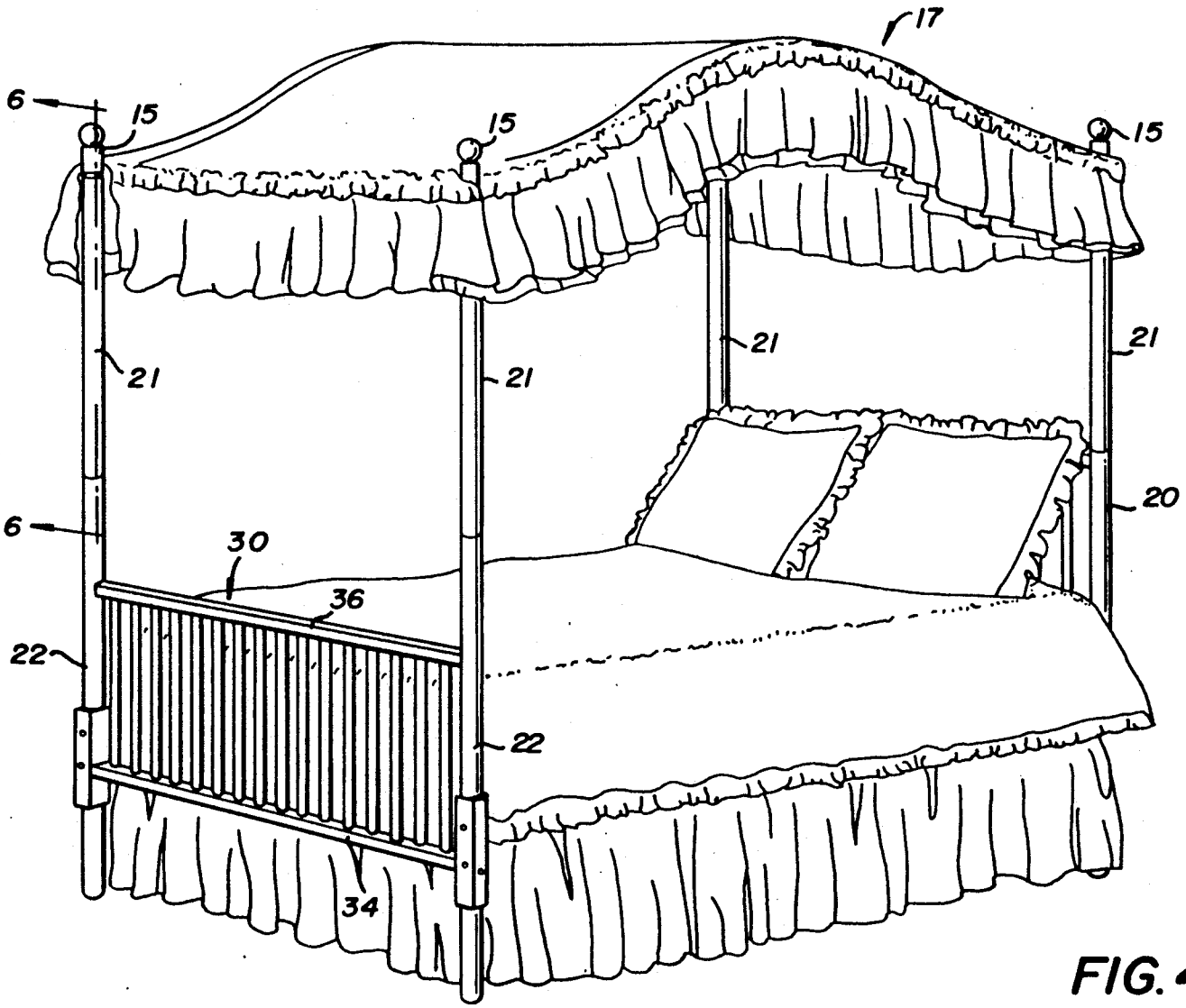
FIG. 4 an isometric view of the embodiment of FIG. 3 with decorative canopy structure attached thereto and standard mounted thereon.

When disassembled and with reference to FIG. 2, the first and the second crib sides 26 and 30, respectively are separated from one another and totally detached from the end portions 12. Further, the fold-down panel 32 is detached from the second crib side 30 as shown. In order to convert certain predetermined components of the crib assembly as shown in FIG. 1 into the adult bed configuration as represented in FIGS. 3 and 4, a first connecting means comprising two pairs of channels 27 are integrally formed in each corner post 20 of the first corner post pair. A second connector means including two channel pairs 31 are integrally formed in each corner post 22 of the second corner post pair. The first connecting means further includes a plurality of connector elements 45 each of which is disposed to pass through one of the connector channels 27 into attached relation with a bracket 52 on a first frame portion 50 of an auxiliary bedding support means generally indicated as 48. Similarly, opposite end of the frame portion 50, as at bracket 52, is secured to the second connector elements 46 disposed in aligned relation with the first connector elements 45 as clearly depicted in FIG. 3.

An oppositely disposed and substantially parallel second frame portion 50' of the auxiliary bedding support 48 is connected in the similar fashion. Accordingly, what originally was the first crib side 26 and the second crib side 30 now respectively define a head and a foot board of the adult bed structure and/or configuration as represented in FIG. 3. A proper mattress and/or like bedding support may be mounted on the frame portions 50 and 50' in the conventional fashion.

With regard to FIG. 4, decorative features may be added to the conventional bed configuration as discussed with reference to FIG. 3 through the provision of corner post extensions 21 mounted on the respective dowels 23 and 25 extending upwardly from the free end of respective corner posts 20 and 22. Similarly, these extensions 21 may also include a similarly formed dowel structure 21' at the upper distal end thereof so as to supportingly engage corner post knobs 15. Finally, a canopy structure generally indicated as 17 may be mounted at the upper free end of the extensions 1 in substantially overhanging and spaced apart relation above the bedding mounted on the auxiliary bedding support means 48 as clearly shown in FIG. 4.

Figure 7:
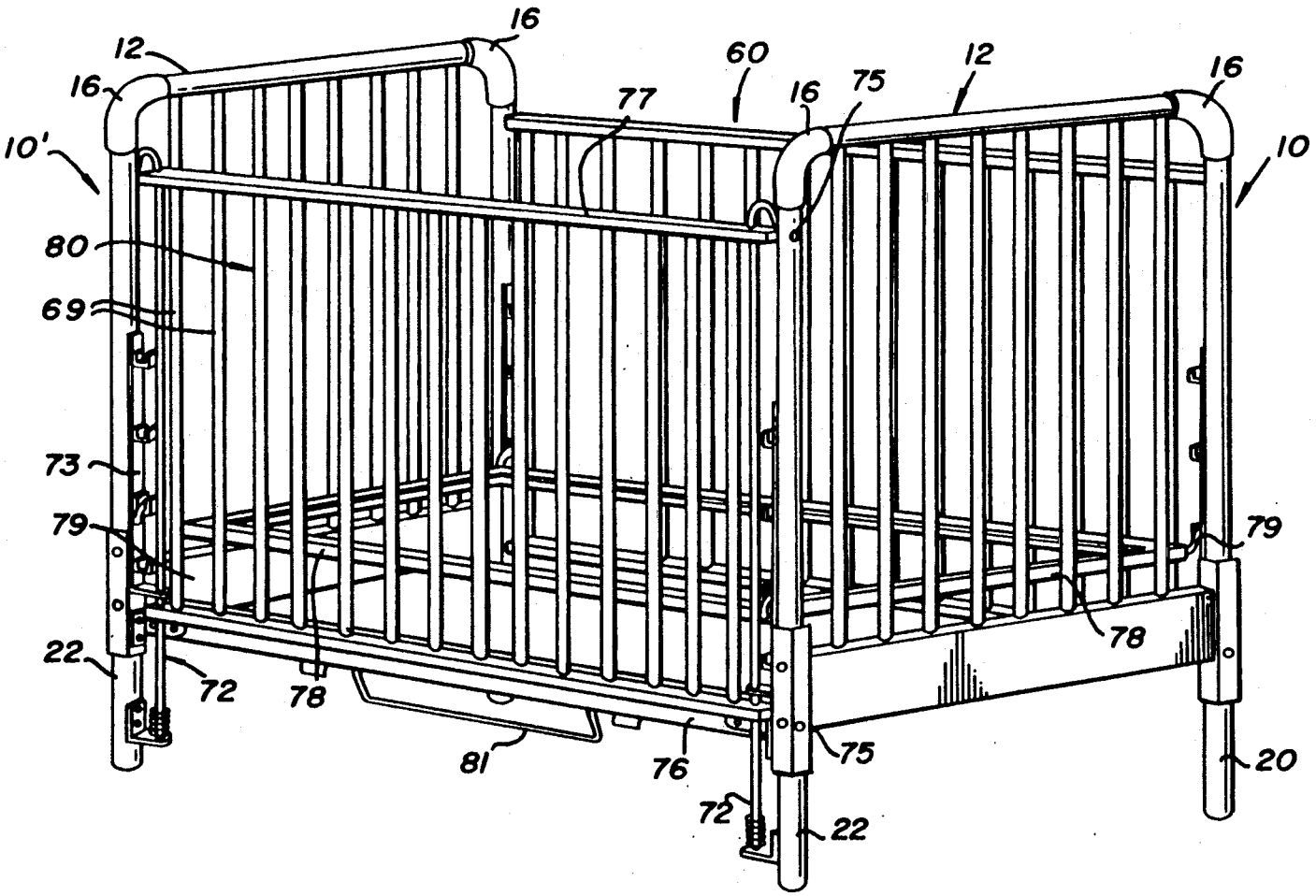
FIG. 7 is another embodiment of the present invention showing different crib sides slidingly mounted relative to the remainder of crib structure when in its crib configuration.
Figure 8:
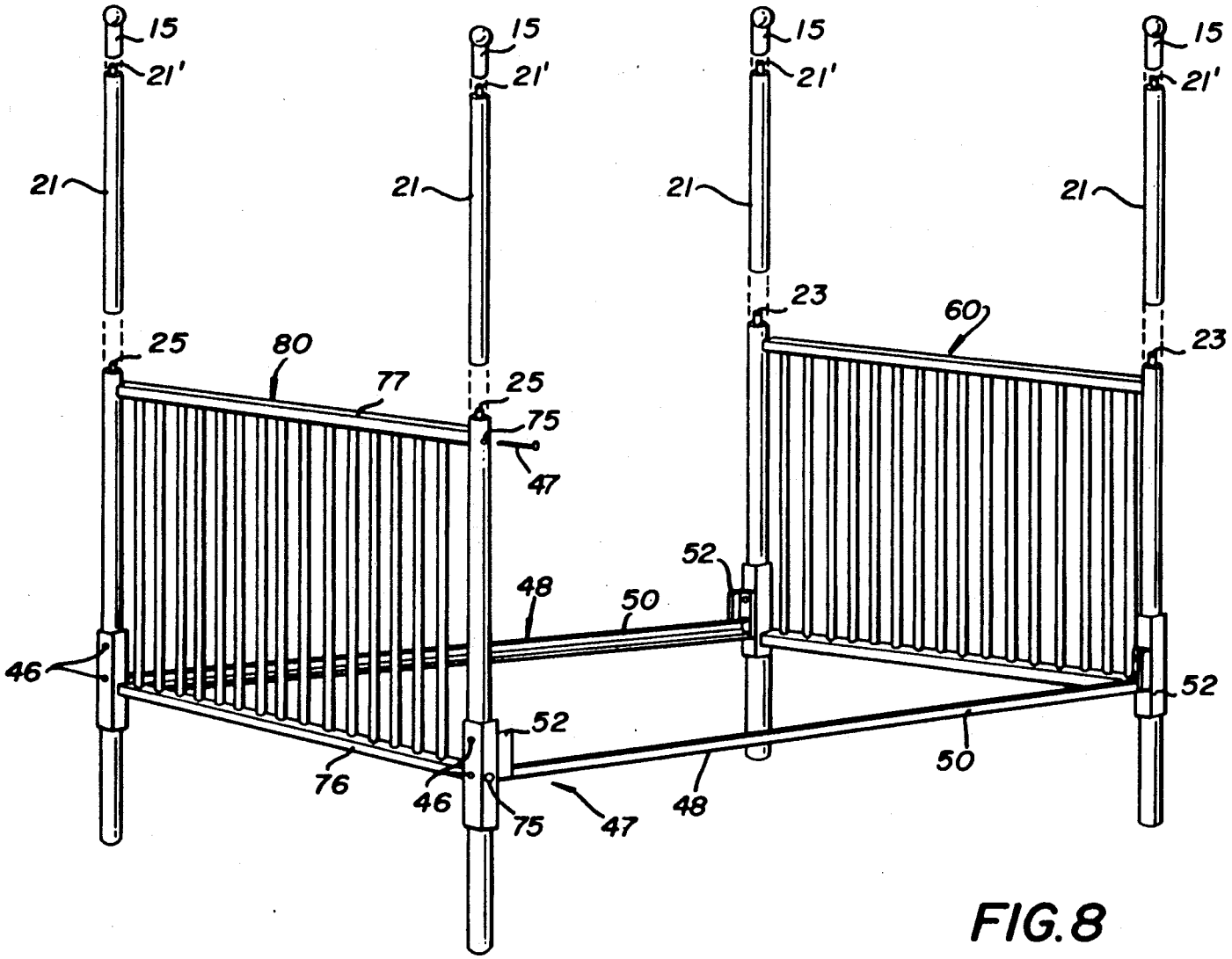
FIG. 8 an isometric view of the embodiment of FIG. 7 when certain predetermined components thereof are disposed in the adult bed configuration wherein decorative corner post extensions are securable thereto.

With regard to FIGS. 7 and 8, the present invention comprises an additional embodiment 10' disposed in a crib configuration wherein a first crib side 60 and a second crib side 80 are disposed in parallel relation to one another as are opposite crib end portions 12. The second crib side 80 includes a plurality of spaced apart poles 69 secured to a base rail 76 and a top rail 77. The primary difference between the embodiment of FIG. 7 and the embodiment of FIG. 1 relies on the fact that the second crib side 80 is slidable relative to the end portion 12 so as to provide clear access to the baby normally disposed on the inside of the crib structure. Therefore, the folding panel 32 (FIG. 2) is eliminated since the downward sliding movement cf the second crib side 80 clearly provides such access. An operating lever 81 serves to detach the base rail 76 from its supporting structure and allows its sliding movement along oppositely disposed slide rods 72 accomplishing the out-of-the-way placement of the second crib side 80. Additional mounting hardware including mattress mounting plates 73 are provided and are generally standard or of conventional design for securing a mattress support frame 78 by hooks 79 in a manner which is well known in the prior art. The remaining components including corner posts 20 defining a first corner post pair and corner posts 22 defining a second corner post pair as well as curved connecting joint 16 are structurally and functionally similar to that relative to the embodiment of FIG. 1. The exception to this is that the embodiment of FIG. 7 comprises a third connecting means in the form of connecting channel 79 extending transversely through each of the corner posts 22 defining the second corner post pair as indicated. Further, each corner post 22 includes a pair of these third connecting channels 75 wherein each connecting channel 9 is structured to have a connecting element 47 extend therethrough into fixed attachment with respective base and top rails 76 and 77 when configured as a bed. By virtue of this connection, fixed attachment occurs between the second crib side 80 and each of the corner post elements 22 defining the second corner post pair. The first and second connecting means associated with the first and second crib sides 60 and 80 are the same as with regard to FIG. 1 as they engage oppositely mounted brackets 52 disposed on opposite ends of the auxiliary support frame portions 50 and 50'.

Similar, corner post extensions 21 may be mounted in the same manner on the embodiment of FIG. 8 as that described with regard to the embodiments of FIG. 4.

Figure 12:
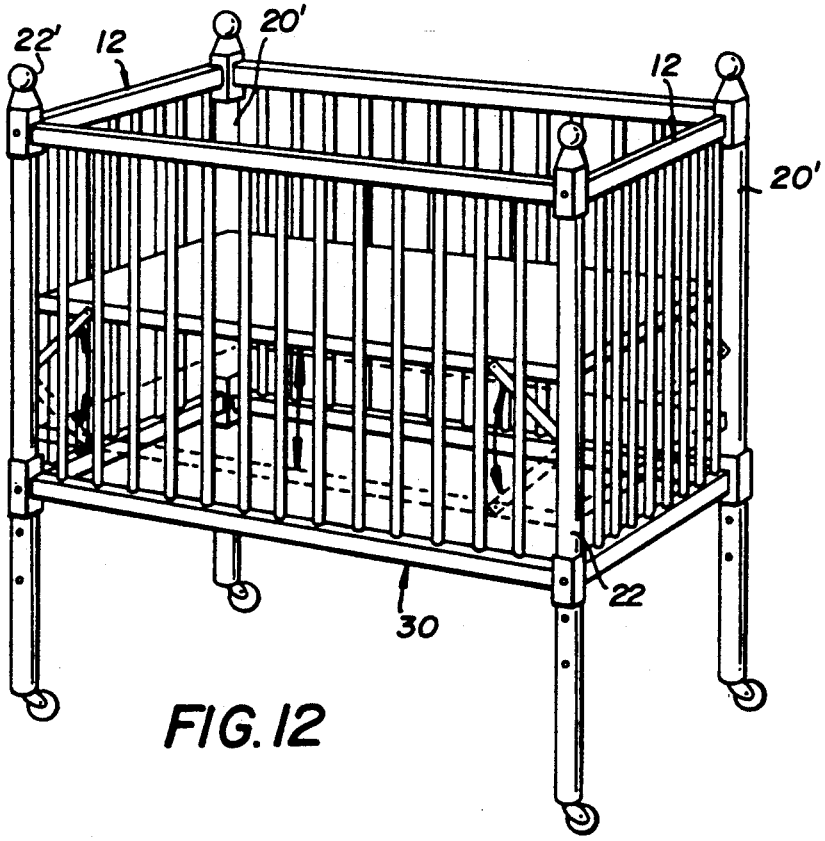
FIG. 12 is an isometric view of yet another embodiment of the present invention.
Figure 13:
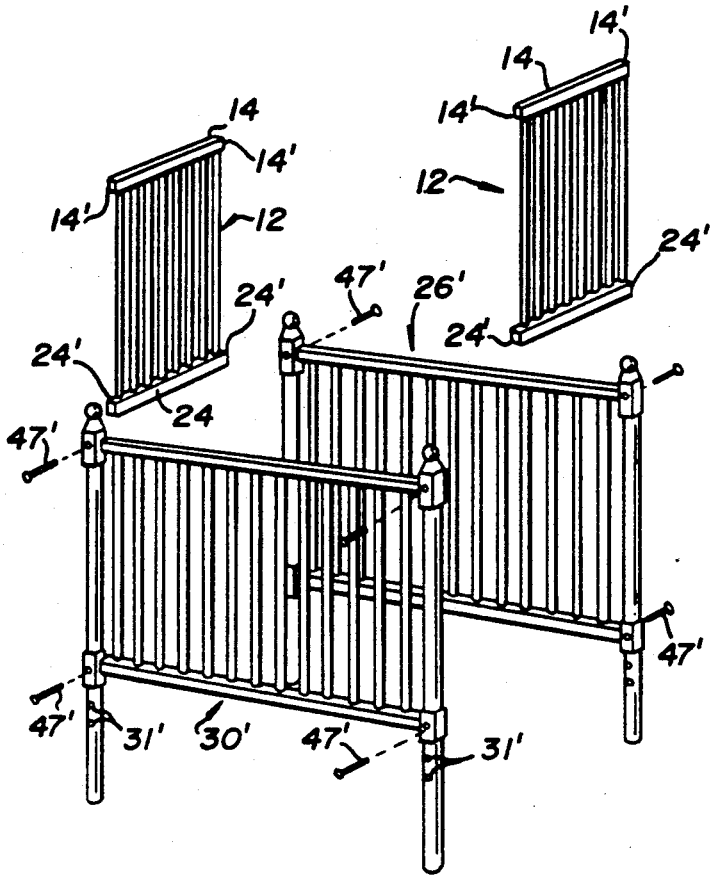
FIG. 13 is an isometric view of the various components comprising the embodiment of FIG. 12 wherein such components are disposed in disassembled relation to one another.
Figure 14:
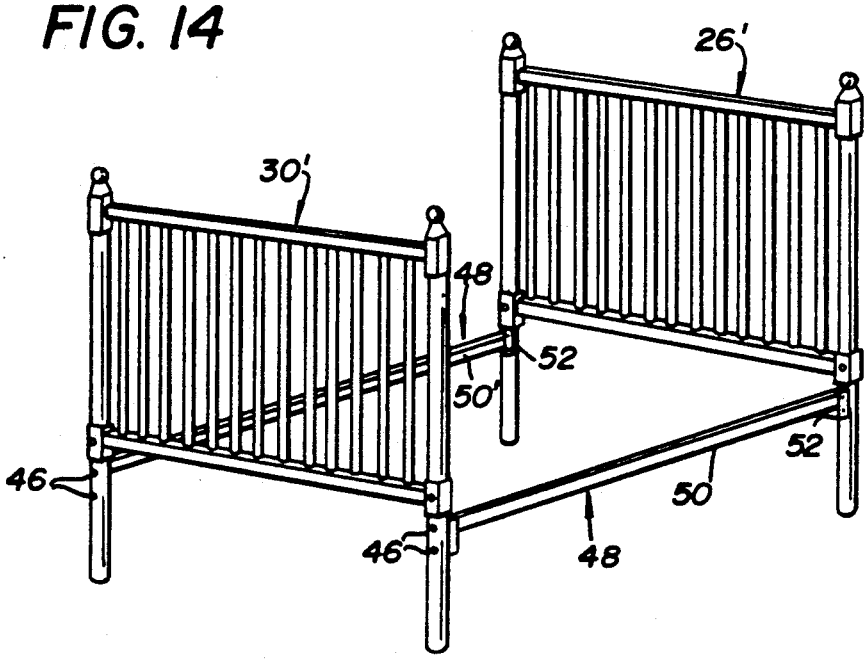
FIG. 14 an isometric view of the embodiments of FIGS. 12 and 13 wherein the various components thereof are shown in assembled relation so as to define an adult bed configuration.

With regard to the embodiments shown in FIGS. 12, 13 and 14, the structure and assembly and disassembly of the various components is the same primarily with regard to the embodiment of FIGS. 1 and 2 wherein opposite end portions 12 are detachable from first crib side 26' and second crib side 30', the primary difference being that both the first and second crib sides 26' and 30' are of the same height and are generally interconnected to respective corner posts 20' and 22' in fixed relation thereto. The embodiments of FIGS. 12 through 14 differ from the embodiment of FIG. 1 in that there is the elimination of the curved connection joint 16 and the crib end portions 12.

In order to detach the end portions 12, connector elements 47' are removed from the second crib side 30' and similarly, such connector elements are removed from the first crib side 26'. These connector elements 47' are similar to connector elements 46 but may have increased length and may thereby be attached and serve as part of the second connecting including the connector elements 46 in connecting channels 51' (see FIGS. 13 and 14). It is to be noted that the connector channels 31' are located somewhat lower than channels 31' of the embodiment of FIGS. 3 and 8 and further, the auxiliary support bedding frame 48 may be of an overall smaller or varying dimension so as to define an infant and/or adult size configuration as represented in FIG. 14.

Figure 9:
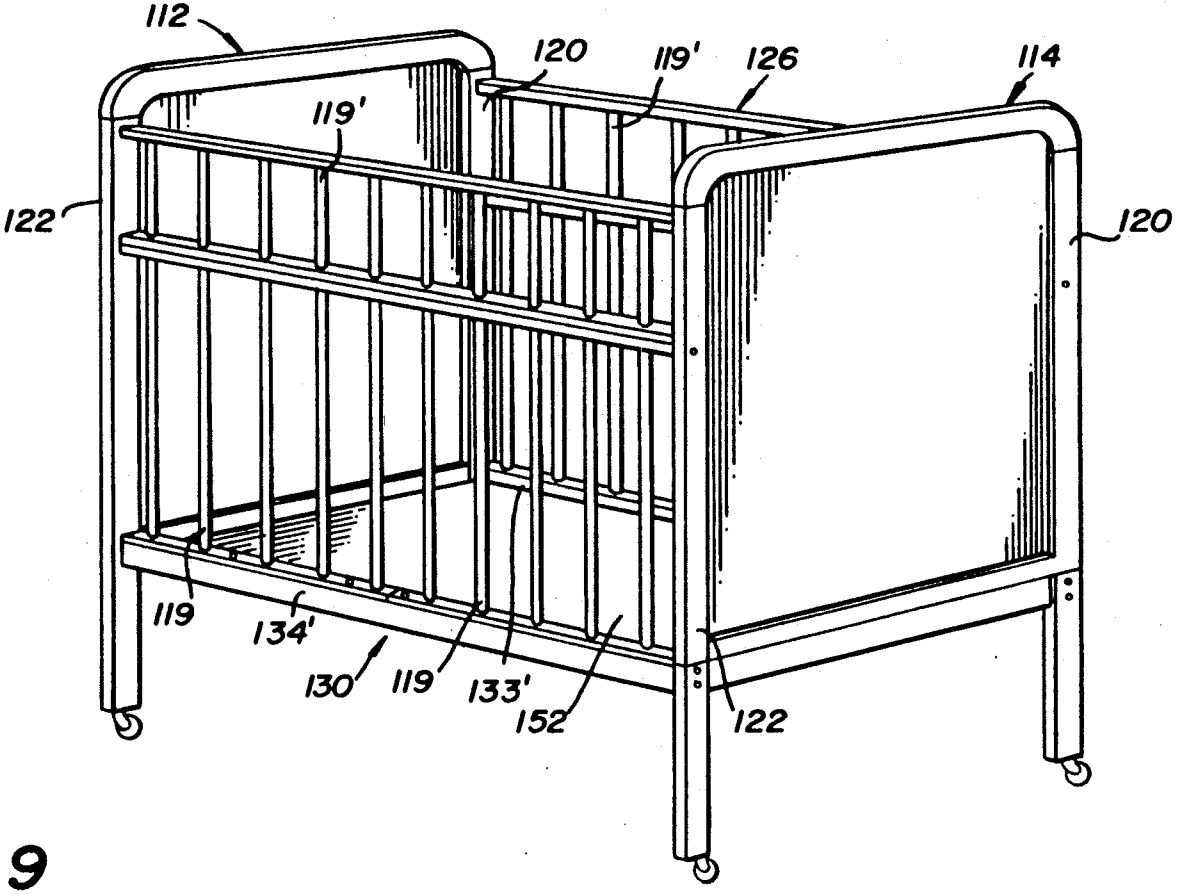
FIG. 9 is an isometric view of yet another embodiment of the present invention wherein the components thereof are interconnected to a crib configuration.
Figure 10:
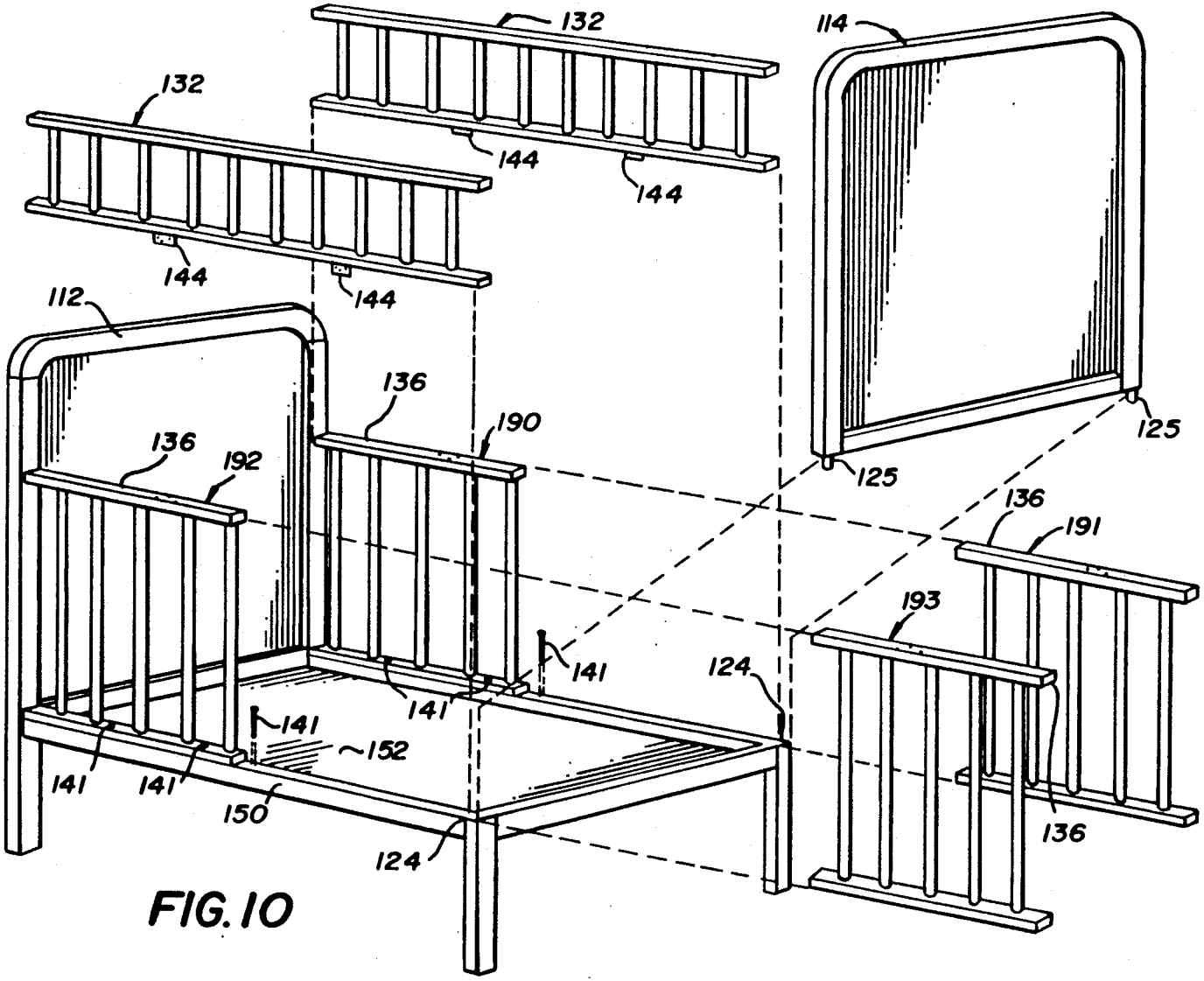
FIG. 10 is an isometric view of the embodiment of FIG. 9 wherein the various components thereof are in a state of disassembly.
Figure 11:
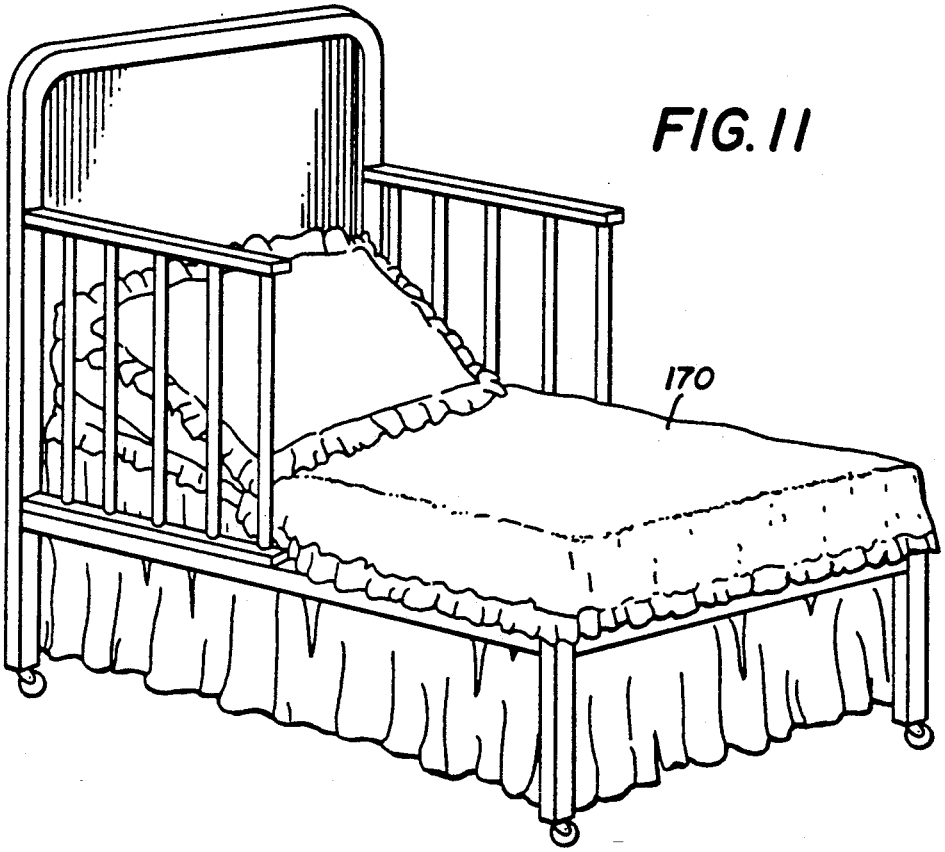
FIG. 11 is an isometric view of the embodiment of FIG. 10 in its completed or assembled orientation to define a substantially conventional adult and/or infant bed configuration.

With regard to the embodiments of FIGS. 9, 10 and 11, the present invention includes opposite ends 112 and 114 disposed in spaced apart, substantially parallel relation to one another and serving to interconnect opposite ends of first crib side 126 and second crib side 130. It is clearly apparent that in the embodiment of FIG. 9 the opposite ends 112 and 114 have a solid configuration rather than a plurality of spaced apart parallel poles or bars while the first and second crib sides 126 and 130 have the similarly structured plurality of bar configurations 119 and 119'. Also, in that opposite ends 112 and 114 are substantially solid, the corner posts 120 and 122 are of substantially fixed or integrally formed relative to these ends. Finally, base rail portions 134' and 133' are structured to form peripheral portions of a support platform 152 on which a proper mattress or the like may be disposed. Also, peripheral support frame 150 is part of both the crib and bed configuration.

With regard to FIG. 10, conversion of the crib assembly as represented in FIG. 9 to the infant and/or adult size bed configuration as shown in FIG. 11 merely comprises the removal of both fold-down panels 132 hingedly attached as at 144 to upper rails 136. The primary difference further comprises the first and the second crib sides 126 and 130 being defined by separable sections 190, 191 and 192, 193 respectively Both of the sections 192, 193, and 190, 191 of the second and first crib sides respectively are affixed by connector elements 141 to the surrounding peripheral support frame 150. Opening of the bottom or lower foot end merely constitutes the removal of side sections 191 and 193 through the removal of connector elements 141 as shown in FIG. 10. Similarly, the end 114 is removed by the displacement of dowel elements 125 from appropriately positioned sockets 124 in a manner which is readily apparent. The removal of such components thereby accomplishes the adult or infant bed configuration as shown in FIG. 11 wherein proper bedding 170 is mounted on the support platform 152 as clearly shown.

It will therefore be understood that the following claims are intended to cover all of the generic and specific features of the invention herein described, and all statements of the scope of the invention which as a matter of language, might be said to fall therebetween.

Now that the invention has been described, what is claimed is:

1. A convertible bed assembly primarily designed to be converted between a crib structure sized for an infant and a substantially conventional bed structure sized for a larger person, said assembly comprising:

(a) a first crib side consisting essentially of a first pair of corner posts, a first top rail extending between and fixed to said first pair of corner posts, a first base rail extending between and fixed to said first pair of corner posts in parallel with said first top rail, and means for vertically interconnecting said first top rail and said first base rail, said first crib side having a length measured along said first top rail and a height measured from ground to said first top rail;

(b) a second crib side consisting essentially of a second pair of corner posts, a second top rail extending between and fixed to said second pair of corner posts, a second base rail extending between and fixed to said second pair of corner posts in parallel with said second top rail, and means for vertically interconnecting said second top rail and second base rail, said second crib side having a length measured along said second top rail equal to said length of said fist crib side, and a height measured from ground to said second top rail less that said height of said first crib side;

(c) a panel hingedly connected to said second top rail and having a length equal to said length of said second crib side and a height equal to a difference between said height of said first crib side and said height of said second crib side; said first crib side and said second crib side together with said panel being structured and dimensioned to define sides of said crib structure and so disposed in space apart substantially parallel relation to one another;

(d) crib end portions interconnected between correspondingly positioned oppositely disposed ends of said first and said second crib sides, said crib end portions disposed to respectively define a crib headboard and a crib footboard and a width of said crib structure; said lengths of said first crib side, said second crib side and said panel being greater than a corresponding length of either of said crib end portions and defining a length of said crib structure; each crib end portion consisting essentially of an end portion top rail, means for vertically interconnecting said end portion top rail and said base board spaced away from respective opposite ends of said end portion top rail and said base board, and connecting joints interconnecting said opposite ends of said end portion top rail to said first and second pairs of corner posts; said crib end portions being detachable from interconnection with said first and second crib sides when forming a bed structure;

(e) a first connecting means formed on said first pair of corner posts in proximity to ends of said first base rail and a second connecting means formed on said second pair of corner posts in proximity to ends of said second base rail, each of said first and second connecting means being disposed in a substantially cooperative, aligned relation to one another and in a substantially transverse orientation with said first and second crib sides respectively; said formed bed structure comprising said first and said second crib sides disposed to define a bed headboard and a bed footboard respectively and structure to define a width of said formed bed structure; and (f) a bedding support means for mounting bedding thereon and being secured to said first and said second connecting means and extending between said bed headboard and said bed footboard in attached relation to said first pair of corner posts and said second pair of corner posts;

whereby replacement of said crib end portions with said bedding support means and removal of said panel converts said crib structure into said formed bed structure, wherein said crib sides define said width of said formed bed structure and said length of said crib structure.

2. An assembly as in claim 1 wherein said first and second connecting means comprises at least one connecting channel formed in each corner post of both said first corner post pair and said second corner post pair and at least one connector element disposed within each of said connecting channels in interconnecting relation between said bedding support means at opposite ends thereof, said bedding support means comprising two frame portions each interconnected between correspondingly positioned and aligned corner posts of opposite corner post pairs.

* * * * *